US005174065A

United States Patent [19]

Schlicht

[11] Patent Number: 5,174,065

[45] Date of Patent: Dec. 29, 1992

[54] DOOR SWEEP WITH FACE SEALING ELEMENT

[75] Inventor: Larry J. Schlicht, Oxford, Mich.

[73] Assignee: The Stanley Works, New Britain, Conn.

[21] Appl. No.: 818,145

[22] Filed: Jan. 8, 1992

[51] Int. Cl.[5] ..... E06B 7/16

[52] U.S. Cl. ..... 49/489; 49/470

[58] Field of Search ..... 49/488, 489, 470, 490, 49/495

[56] References Cited

U.S. PATENT DOCUMENTS

| | | | |
|---|---|---|---|
| 3,448,543 | 6/1969 | Multer | 49/488 X |
| 3,854,246 | 12/1974 | McAllister | 49/488 X |
| 4,006,562 | 2/1977 | Belanger et al. | 49/470 X |
| 4,756,944 | 7/1988 | Kisanuki | 49/490 X |
| 5,056,263 | 10/1991 | Bies | 49/488 |

*Primary Examiner*—Philip C. Kannan

[57] ABSTRACT

A door sweep is integrally formed of synthetic resin with a generally planar body portion which is mounted on the bottom of the door and a face sealing portion along its one side. This includes a sealing element which extends upwardly from the body portion and has an inner surface adapted to bear against the surface of the door. A pivot arm on the inner face of the sealing element intermediate its length extends in the direction of the other side of the body portion. When the door sweep is moved against the bottom edge of the door, the pivot arm is pushed towards the body portion and the sealing element is pivoted against the face of the door. Sealing elements depending from the other face of the body portion provide a seal between the door and its sill.

17 Claims, 3 Drawing Sheets

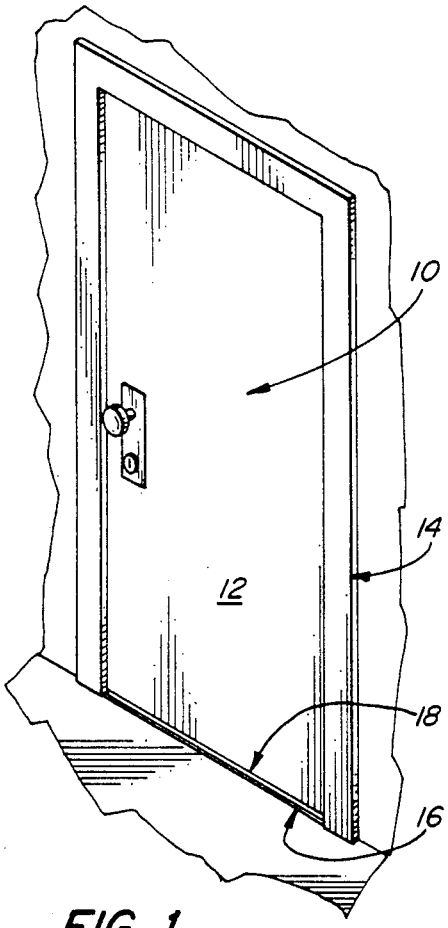
FIG. 1
FIG. 2
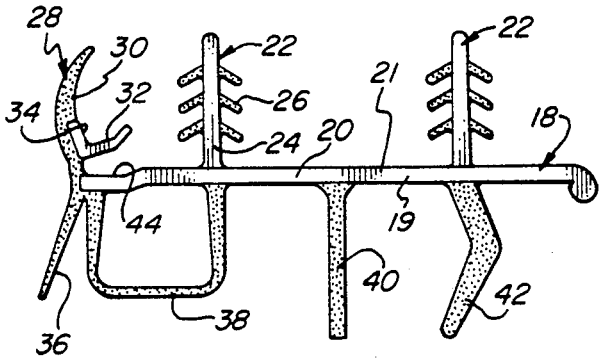
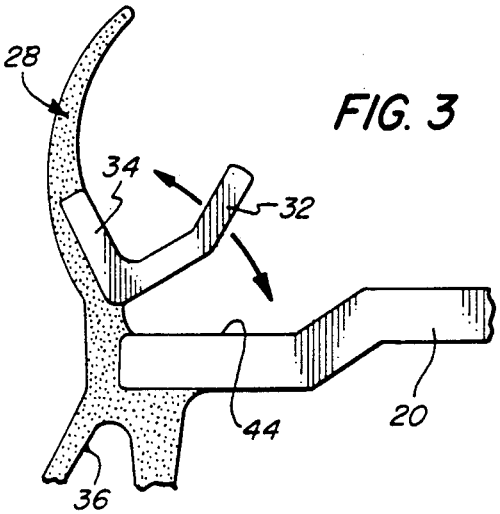
FIG. 3
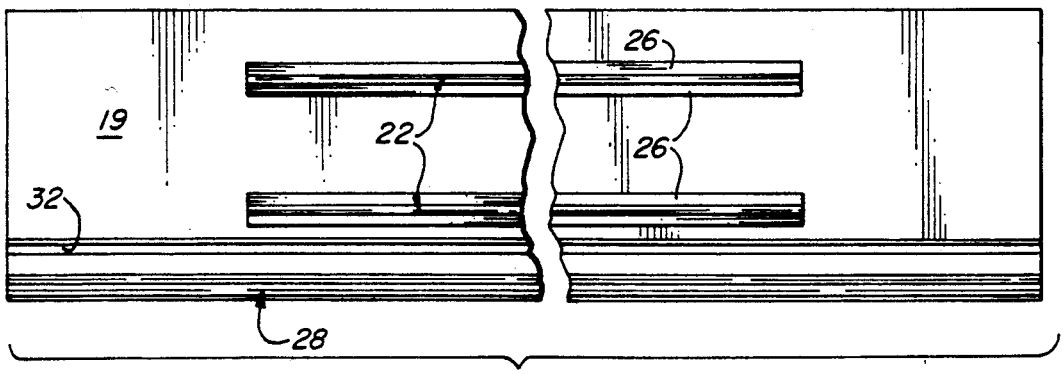
FIG. 4

DOOR SWEEP WITH FACE SEALING ELEMENT

BACKGROUND OF THE INVENTION

The present invention relates to weatherstripping for doors, and, more particularly, to weatherstripping of the type employed at the bottom of the door to cooperate with a sill or a threshold to provide a seal therewith.

Various types of weatherstripping have been developed for use with wooden, clad, and synthetic resin entry doors to provide effective seals about the periphery thereof. Clad doors frequently have wooden stiles and rails providing a frame, and metal or plastic skins are secured thereto. With clad doors having a bottom rail, it is common to cut channels into the bottom rail to seat mounting elements on the weatherstripping member to effect its assembly thereto.

With such clad doors, and indeed all doors, it is desirable that there be an effective seal between the outer face of the door and the bottom weatherstrip element to ensure that there is no penetration of water and/or air therebetween, and it is not uncommon for beads of sealant to be applied between the weatherstrip and the door in an effort to effect such a seal. If the sealant bead is not adequate or dries out and cracks, the desired seal therebetween is lost. Failure to provide an effective seal can result in the penetration of water into the interface and ultimate rotting of a wooden rail as well as corrosion of metal skins. Moreover, in some clad doors, the skin does not extend to the bottom of the rail.

It has heretofore been proposed to provide an upwardly extending sealing fin on a bottom sweep to extend along the front surface of the door to provide a seal overlapping the interface. However, the process of assembling such a bottom sweep to the door may result in the inadvertent capture of the sealing fin under the edge of the door and crushing of the fin between the door and the body portion of the bottom sweep.

It is an object of the present invention to provide a novel bottom sweep having an upwardly extending sealing fin which does not interfere with the assembly process and which is brought into sealing engagement with the front face of the door upon assembly.

It is also an object to provide such a bottom sweep which can be quickly and economically fabricated as a unitary structure and which may be readily mounted.

Another object is to provide such a bottom sweep which fits tightly against the bottom edge of the door while providing good sealing engagement to the face of the door to prevent penetration of water and air therebetween.

SUMMARY OF THE INVENTION

It has now been found that the foregoing and related objects may be readily attained in a bottom door sweep integrally formed of synthetic resin and comprising a generally planar body portion with mounting means on one face of the body portion adapted to secure the sweep to the bottom of a door. A face sealing portion is provided at one side of the body portion and includes a sealing element extending upwardly from the one face and having an inner surface adapted to bear against the surface of a door. The face sealing portion also includes a pivot arm on the inner face of the sealing element intermediate its length and extending in the direction of the other side of the body portion. When the door sweep is placed against the bottom edge of a door, the pivot arm is deflected towards the body portion by the door and the sealing element is pivoted against the face of the door. The door sweep also includes sealing means depending from the other face of the body portion to provide a seal between the door and its sill.

In the preferred embodiment, the body portion is molded from a relatively rigid resin and the sealing element is molded from a relatively flexible resin. Desirably, the sealing element is of convexly arcuate cross section and tapers to a reduced cross section at its end. The body portion provides a depression to receive the pivot arm when it is pivoted downwardly by the associated door.

In one embodiment, the pivot arm is inclined upwardly and a lever finger extends upwardly from its inner end along the sealing element to effect the pivoting of the upper end of the sealing element upon deflection downwardly of the pivot arm. In another embodiment, the pivot arm is inclined downwardly from the sealing element toward the body portion and is connected at its lower end to the body portion. This pivots the upper end of the sealing element when it is depressed.

Desirably, the mounting means comprises at least one mounting element extending generally perpendicularly to the one face intermediate the ends of the body portion and adapted to seat in a channel in the bottom edge of the door. The sealing means includes depending elements at both sides of the body portion.

In the door assembly, a door having a pair of opposed faces and a bottom edge has the door sweep mounted on the bottom edge of the door and the sealing element extends upwardly with its inner surface bearing against the front surface of the door. The pivot arm on the inner face of the sealing element is pressed downwardly against the body portion by the door. The preferred structure has a depression in the upper face of the body portion into which the pivot arm is pressed.

BRIEF DESCRIPTION OF THE DRAWINGS

FIG. 1 is a fragmentary perspective view of installation including the door sweep of the present invention;

FIG. 2 is a side elevational view of the door sweep of the present invention;

FIG. 3 is a fragmentary view thereof to an enlarged scale diagrammatically showing the pivotal motion of the pivot arm and face sealing element;

FIG. 4 is a fragmentary top plan view of the door sweep of FIGS. 2 and 3;

DETAILED DESCRIPTION OF THE PREFERRED EMBODIMENTS

Figure 6:
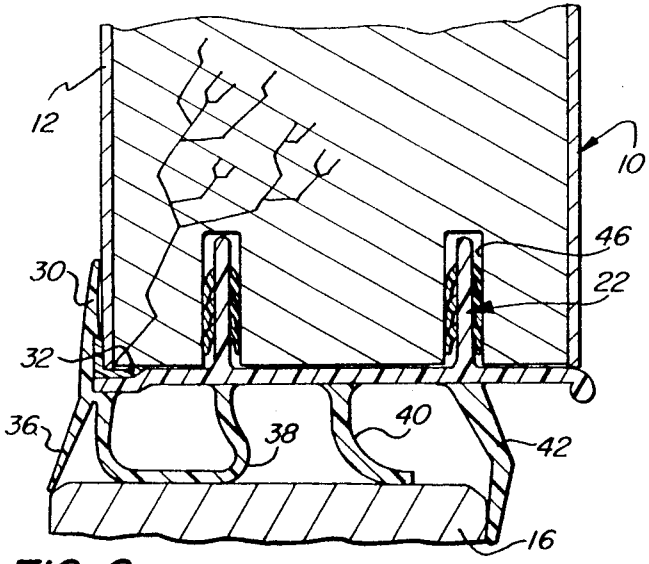
FIG. 6 is a fragmentary cross sectional view of the lower edge of the door assembly of FIG. 1 drawn to an enlarged scale.

Turning first to FIG. 1, therein illustrated is a door installation embodying the door sweep of the present invention. The door, generally indicated by the numeral 10, has a front or outer face 12 and is pivotally mounted within a door frame generally indicated by the numeral 14. Along the bottom edge of the door 10 is a bottom door sweep of the present invention generally designated by the numeral 18 which provides a seal against the sill 16.

Turning now to FIGS. 2–7, therein illustrated in detail is a bottom sweep 18 which has a horizontal body portion 20 with a lower face 19 and an upper face 21. Extending perpendicularly to the upper face 21 are mounting members generally designated by the numeral 22 and including the post or arm portions 24 and the downwardly angled fingers or barbs 26.

At the front or outer face of the body portion 20 and extending upwardly therefrom is the face sealing portion generally designated by the numeral 28 and comprised of the convexly arcuate resilient sealing fin 30, and a L-shaped pivot member therefor comprising the rearwardly and upwardly extending pivot arm 32 and the upwardly extending lever finger 34. As can be seen, the fin 30 tapers to a reduced cross section at its upper end.

Extending downwardly and outwardly from the body portion 20 is the sill wiper fin 36. Also depending from the bottom surface 19 of the body portion 20 are the box seal element 38, the intermediate sealing fin 40 and the inner sealing fin 42.

As can be seen in FIGS. 2 and 3, the body portion 20 is configured to provide a recess or depression 44 adjacent the face sealing portion 28 for a purpose to be described more fully hereinafter.

The stipling of some of the elements of the bottom sweep 18 indicates portions which are fabricated from a relatively soft, resilient resin whereas the absence of stipling represents those portions which are fabricated from a relatively rigid synthetic resin. Coextrusion of relatively soft and relatively rigid resins is known in the art of weatherstripping and is extensively practiced so as to provide the characteristics to the portions of the weatherstripping desired for their proper functioning and long life.

As can be seen in FIG. 4, the mounting elements 22 do not extend the full length of the bottom sweep 18 but are of sufficient length to ensure firm seating in recesses or channels 46 routed or otherwise formed in the bottom rail of the door. In mounting the bottom sweep 18 on the bottom rail of the door 10, the mounting elements 22 are forced into the channels 46 causing the barbs 26 to deflect downwardly and be compressed, thereby providing a high degree of frictional retention within the channels 46.

In the process of mounting the bottom sweep 18 on the bottom edge of the door, the face sealing portion 28 is initially free from contact with the outer face 12 of the door or is deflected slightly outwardly thereby. As the bottom sweep 18 is moved towards the bottom edge of the door 10, the bottom edge contacts the pivot arm 32 pushing it downwardly, as shown by the arrow in FIG. 3, and this causes the lever finger 34 to pivot the resilient sealing fin 30 against the outer face 12 of the door 10 and into the position seen in FIGS. 6 and 7. When the door 10 is fully seated against the body portion 20, the pivot arm 32 is deflected into the depression 44 in the upper surface 21 of the body portion 20.

Figure 7:
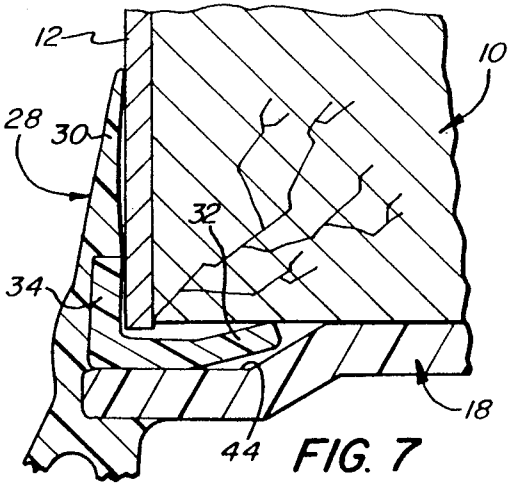
FIG. 7 is an enlarged fragmentary view of the assembly of FIG. 6.
Figure 5:
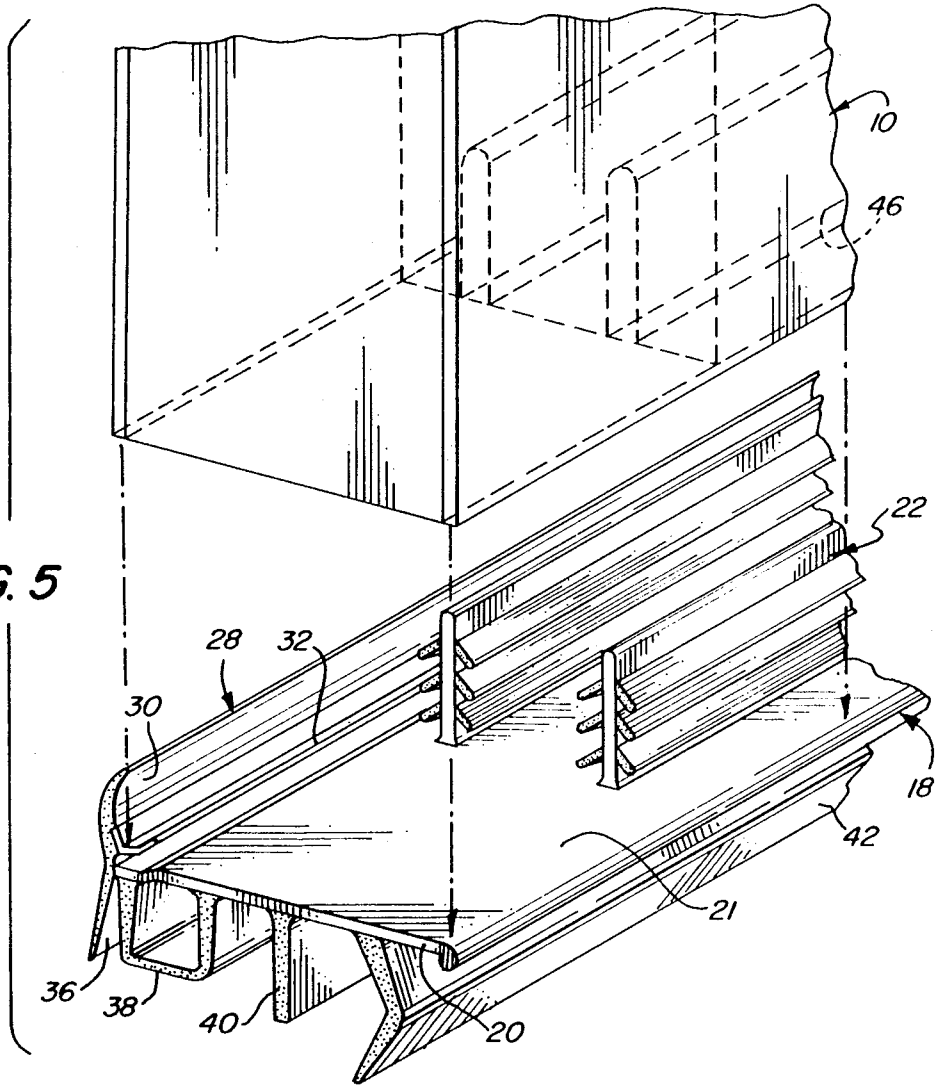
FIG. 5 is a fragmentary perspective view of the door sweep and the door on which it is to be mounted.

As can be seen in FIGS. 6 and 7, the sealing fin 30 of the bottom sweep 18 provides an excellent seal along the front or outer face 12 of the door 10 to prevent water from seeping into the interface between the bottom sweep 18 and the bottom edge of the door 10.

As also seen in FIG. 6, the spacing between the bottom edge of the door 10 and the sill 16 is slightly less than the vertical length of the sealing elements 38 and 40 so that they will be deflected when the door 10 is closed and positioned over the sill 16. The sill wiper fin 36 extends to the front edge of the sill 16 to effect a seal therewith and the longer inner sealing fin 42 extends along the inner face of the sill 16 to provide a further seal.

Figure 8:
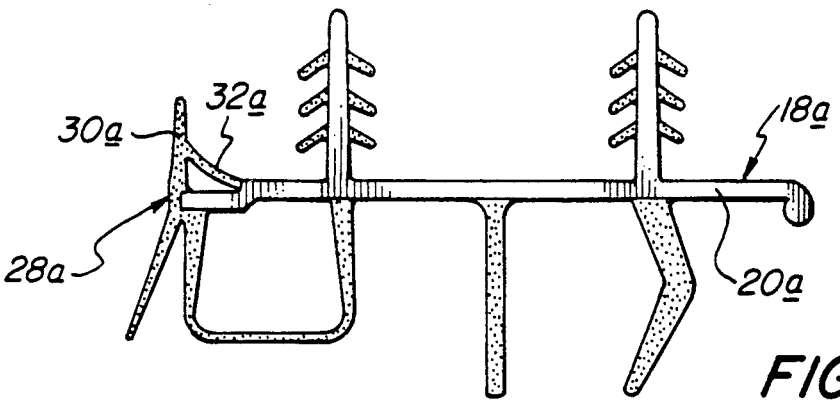
FIG. 8 is a side elevational view of another embodiment of the door sweep of the present invention.
Figure 9:
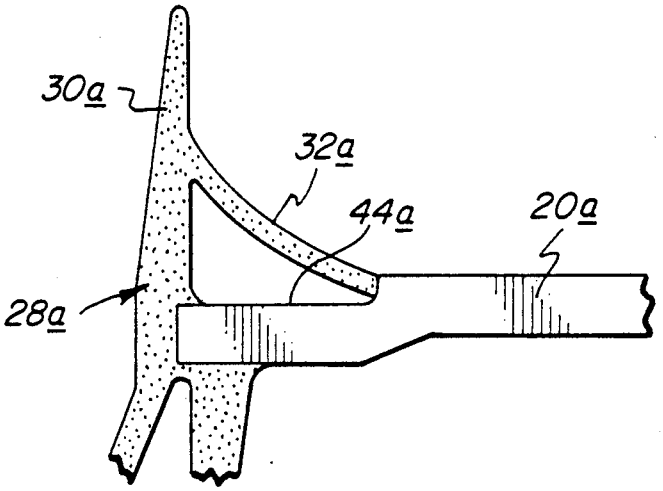
FIG. 9 is an enlarged fragmentary side elevational view thereof.
Figure 10:
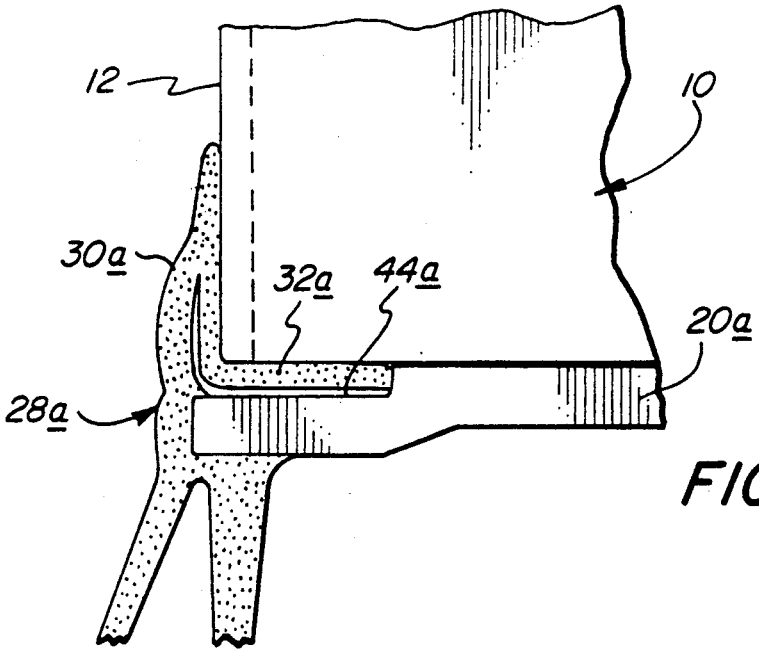
FIG. 10 is a fragmentary side elevational view of the embodiment of FIGS. 8 and 9 as mounted on the lower edge of a fragmentarily illustrated door.

Turning now to the embodiment of FIGS. 8–10, the face sealing fin 30*a* extends generally perpendicularly, and it tapers to a reduced width at its upper end. The pivot arm 32*a* in this embodiment extends downwardly at an angle from the resilient sealing fin 30*a* to the body portion 20*a* and joins thereto at the inner side of the depression 44*a*. In this embodiment, the pivot arm 32*a* is pressed downwardly by the bottom edge of the door 10 causing the sealing fin 30*a* to be deflected inwardly and to bear firmly against the front face 12 of the door 10. As in the case of the prior embodiment, the deflected pivot arm 32 seats within the depression or recess 44*a* in the body portion 20*a*.

In either of the illustrated embodiments, it will be appreciated that the sealing fin 30 is in rest position during initial assembly of the bottom sweep to the bottom edge of the door wherein it avoids engagement by the door. As a result, the upper end moves along the outer face 12 of the door 10 until the pivot arm 32 is acted upon by the bottom edge of the door 10. This causes the resilient sealing fin 30 to be brought to bear firmly against the front face 12 of the door 10. In the embodiment of FIGS. 1–7, this is effected by the pivotal action occasioned by the downward pressure on the pivot arm 32. In the embodiment of FIGS. 8–10, the deformation and deflection of the depending pivot arm 32*a* produces comparable deflection and sealing pressure against the front face of the door 10 as the element 32*a* is deformed into the position seen in FIG. 10.

Other configurations for the actuating element or pivot arm may also be employed to provide the same effect of bringing the sealing fin tightly against the front face of the door as the bottom edge moves against the body portion of the bottom sweep.

The configuration and number of the sealing elements which depend from the body portion may vary considerably depending upon the preference of the designer. However, it is desirable to have a depending sealing fin to seal against the outer edge of the sill and another to seal against the inner edge of the sill as well as at least one intermediate sealing element.

The bottom sweeps of the present invention are conveniently fabricated by extrusion of dual durometer synthetic resins such as polyvinyl chloride. As a specific example, the bottom sweep being made by Applicant's assignee, uses for the flexible portions of the structure, a polyvinyl chloride having a Shore A hardness of 65–75 and, for the rigid portions, a polyvinyl chloride having a Shore D hardness of 72–80.

Thus, it can be seen from the foregoing detailed description and attached drawings that the bottom sweep of the present invention is one which provides a highly effective seal along the lower edge of the outer face of the door substantially to preclude the penetration of moisture and air between the bottom edge of the door and the bottom sweep. The bottom sweeps of the present invention may be readily assembled to the bottom edge of the door with substantially preclusion of the problem of trapping the face sealing fin between the bottom edge of the door and the body portion of the sweep. However, continuation of the assembly operation ensures that the face sealing element will firmly seat and seal against the face of the door when the bottom sweep is fully assembled. The novel bottom sweep may be fabricated readily and relatively economically from conventional resins.

Having thus described the invention, what is claimed is:

1. A bottom door sweep integrally formed of synthetic resin and comprising:

(a) a generally planar body portion;

(b) mounting means on one face of said body portion adapted to secure said sweep to the bottom of an associated door;

(c) a face sealing portion along one side of said body portion and including a sealing element at said one side extending upwardly from said one face and having an inner surface adapted to bear against the surface of the associated door, said face sealing portion including a pivot arm on the inner face of said sealing element intermediate its length and extending in the direction of the other side of said body portion whereby, when said door sweep is placed against the bottom edge of an associated door, said pivot arm is deflected towards said body portion by the associated door and said sealing element is pivoted against the face of the associated door; and (d) sealing means depending from the other face of said body portion to provide a seal between the associated door and an associated sill.

2. The door sweep in accordance with claim 1 wherein said body portion is molded from a relatively rigid resin and said sealing element is molded from a relatively flexible resin.

3. The door sweep in accordance with claim 1 wherein said sealing element is of convexly arcuate cross section.

4. The door sweep in accordance with claim 1 wherein said sealing element tapers to a reduced cross section at its end.

5. The door sweep in accordance with claim 1 wherein said body portion provides a depression to receive said pivot arm when it is pivoted downwardly by the associated door.

6. The door sweep in accordance with claim 1 wherein said pivot arm is inclined upwardly and a lever finger extends upwardly from its inner end along said sealing element to effect the pivoting of the upper end of said sealing element upon deflection downwardly of said pivot arm.

7. The door sweep in accordance with claim 1 wherein said pivot arm is inclined downwardly from said sealing element toward said body portion and connected at its lower end to said body portion, whereby deflection downwardly of said pivot arm will cause the upper portion of said sealing element to pivot against the face of the associated door.

8. The door sweep in accordance with claim 1 wherein said mounting means comprises at least one mounting element extending generally perpendicularly to said one face intermediate the ends of said body portion and adapted to seat in a channel in the bottom edge of the associated door.

9. The door sweep in accordance with claim 1 wherein said sealing means includes depending elements at both sides of said body portion.

10. A door assembly including:

(a) a door having a pair of faces and a bottom edge;

(b) a door sweep mounted on the bottom edge of said door and having a generally planar body portion, mounting means on its one face adjacent said door securing said sweep to the bottom edge of said door;

(c) a face sealing portion at one side of said body portion and including a sealing element at said one side extending upwardly from said one face and having its inner surface bearing against the front face of said door, said face sealing portion including a pivot arm on said inner face of said sealing element intermediate its length and extending in the direction of the other side of said body portion and pressed downwardly against said body portion by said door; and (d) sealing means depending from the other face of said body portion to provide a seal between said door and an associated sill.

11. The door assembly in accordance with claim 10 wherein said body portion is molded from a relatively rigid resin and said sealing element is molded from a relatively flexible resin.

12. The door assembly in accordance with claim 10 wherein said sealing element is of convexly arcuate cross section.

13. The door assembly in accordance with claim 10 wherein said sealing element tapers to a reduced cross section at its upper end.

14. The door assembly in accordance with claim 10 wherein the upper face of said body portion provides a depression in which said pivot arm is received.

15. The door assembly in accordance with claim 10 wherein a lever finger extends upwardly from the inner end of said lever arm along said sealing element to pivot the upper end of said sealing element against said door.

16. The door assembly in accordance with claim 10 wherein said pivot arm extends between said sealing element and said body portion.

17. The door assembly in accordance with claim 10 wherein said sealing means includes depending elements at both sides of said body portion.

* * * * *